US006041782A

United States Patent [19]

Angadjivand et al.

[11] Patent Number: 6,041,782

[45] Date of Patent: Mar. 28, 2000

[54] RESPIRATORY MASK HAVING COMFORTABLE INNER COVER WEB

[75] Inventors: Seyed Abolhassan Angadjivand, Woodbury; Tammy M. Chalmers, Cottage Grove, both of Minn.; James F. Dyrud, New Richmond, Wis.; Simon A. Mortimer, Darlington, United Kingdom; Scott J. Tuman, Woodbury; Cynthia Y. Tamaki, Arden Hills, both of Minn.; Graham J. Bostock, Darlington, United Kingdom

[73] Assignee: 3M Innovative Properties Company, St. Paul, Minn.

[21] Appl. No.: 08/881,348

[22] Filed: Jun. 24, 1997

[51] Int. Cl.[7] ..... A62B 7/10

[52] U.S. Cl. ..... 128/206.19; 128/206.16; 128/205.27; 128/205.29

[58] Field of Search ..... 128/206.19, 206.16, 128/205.27, 205.28, 205.29; 2/9, 206; 428/36.1, 284, 373, 298, 229

[56] References Cited

U.S. PATENT DOCUMENTS

| | | | |
|---|---|---|---|
| Re. 31,285 | 6/1983 | van Turnhout et al. | 55/155 |
| 3,220,409 | 11/1965 | LiLoia et al. . | |
| 4,013,816 | 3/1977 | Sabee et al. | 428/288 |
| 4,215,682 | 8/1980 | Kubik et al. | 128/205.29 |
| 4,363,682 | 12/1982 | Thiebault | 156/181 |
| 4,536,440 | 8/1985 | Berg | 428/284 |
| 4,547,420 | 10/1985 | Krueger et al. | 428/229 |
| 4,551,378 | 11/1985 | Carey, Jr. | 428/198 |
| 4,588,537 | 5/1986 | Klaase et al. | 264/22 |
| 4,684,570 | 8/1987 | Malaney | 428/296 |
| 4,798,850 | 1/1989 | Brown | 521/134 |
| 4,807,619 | 2/1989 | Dyrud et al. | 128/206.16 |
| 4,827,924 | 5/1989 | Japuntich | 128/206.16 |
| 4,850,347 | 7/1989 | Skov | 128/206.16 |
| 4,873,972 | 10/1989 | Magidson et al. | 128/206.12 |
| 5,073,436 | 12/1991 | Antonacci et al. | 428/219 |
| 5,114,787 | 5/1992 | Chaplin et al. | 428/284 |
| 5,173,356 | 12/1992 | Eaton et al. | 428/219 |
| 5,225,014 | 7/1993 | Ogata et al. | 156/73.2 |
| 5,307,796 | 5/1994 | Kronzer et al. | 128/206.16 |
| 5,325,892 | 7/1994 | Japuntich et al. | 137/855 |
| 5,374,458 | 12/1994 | Burgio | 128/206.16 |
| 5,496,507 | 3/1996 | Angadjivand et al. | 264/423 |
| 5,558,089 | 9/1996 | Castiglione | 128/206.24 |
| 5,620,785 | 4/1997 | Watt et al. | 428/219 |
| 5,807,796 | 9/1998 | Degrand et al. . | |

FOREIGN PATENT DOCUMENTS

| | | | |
|---|---|---|---|
| 0 038 743 A1 | 4/1981 | European Pat. Off. . | |
| 0 241 221 A1 | 4/1987 | European Pat. Off. . | |
| 0 416 620 A2 | 3/1991 | European Pat. Off. | B32B 5/26 |
| 0 534 863 A1 | 3/1993 | European Pat. Off. | D04H 1/54 |
| 0 582 286 A1 | 8/1993 | European Pat. Off. . | |
| 107298 | 3/1987 | Taiwan . | |
| 1 569 812 | 6/1980 | United Kingdom | A62B 7/10 |
| 2 280 620 | 2/1995 | United Kingdom | A62B 18/02 |
| WO 93/25746 | 12/1993 | WIPO | D04H 13/00 |
| WO 96/09165 | 3/1996 | WIPO | B32B 27/12 |
| WO97/07272 | 2/1997 | WIPO | D04H 1/42 |

OTHER PUBLICATIONS

Wente, Van A., "Superfine Thermoplastic Fibers", Industrial Engineering Chemistry, vol. 48, 1342 et seq. (1956).

Moldex Respiratory Mask.

*Primary Examiner*—John G. Weiss
*Assistant Examiner*—V. Srivastava
*Attorney, Agent, or Firm*—Cecilia Hill; Karl G. Hanson

[57] ABSTRACT

A respiratory mask 1 has a molded, cup-shaped, shape-retaining shell 10 on the concave side of which is a layer of filter material 11 and, on the concave side of the filter material, without any intermediate shape-retaining layer, a layer of nonwoven material 12. The layer of filter material 11 and the inside layer 12 are conformed into the cup-shaped configuration of the shape-retaining shell 10. The inside layer 12 is preferably a smooth BMF material offering improved comfort to the wearer.

29 Claims, 2 Drawing Sheets

RESPIRATORY MASK HAVING COMFORTABLE INNER COVER WEB

TECHNICAL FIELD

This invention pertains to a molded fibrous respiratory mask that is comfortable to wear.

BACKGROUND

Persons wear respiratory masks (also referred to as "face masks" and "filtering face masks") for two common purposes: (1) to prevent contaminants from entering the wearer's respiratory system; and (2) to protect others from being exposed to pathogens and other contaminants exhaled by the wearer. In the first situation, the respirator is worn in an environment where the air contains substances harmful to the wearer—for example, in an auto body shop. In the second situation, the respirator is worn in an environment where there is a high risk of infection—for example, in an operating room.

Investigators believe that comfortable masks are much more likely to be worn and therefore are more beneficial from a safety standpoint. Because safety of the wearer and others is a primary concern in respirator development, investigators in the respirator art have directed efforts towards producing masks that are comfortable to wear (see e.g., U.S. Pat. No. 5,307,796).

Some respiratory masks are categorized as "disposable" because they are intended to be used for relatively short time periods. These masks are typically made from nonwoven fibrous webs. Fibers that protrude from the web have caused wearer discomfort by creating a tickling sensation that makes wearers want to scratch that area of their face. When a mask is worn to protect the wearer from breathing impurities in the air or to protect others from infection, the wearer becomes confronted with the choice of tolerating the itching sensation or risking exposure of themselves or others to potentially dangerous contaminants.

Disposable respiratory masks generally fall into two different categories, namely, fold-flat masks and molded masks. Fold-flat masks are packed flat but are formed with seams, pleats and/or folds that enable them to be opened into a cup-shaped configuration. Molded masks, however, are preformed into a desired face-fitting configuration and generally retain that configuration during use.

Molded respiratory masks are commonly made from thermally bonding fibers. Thermally bonding fibers bond to adjacent fibers after being heated and cooled. Examples of face masks formed from such fibers are shown in U.S. Pat. Nos. 4,807,619 and 4,536,440. The face masks disclosed in these patents are cup-shaped masks that have at least one layer of thermally bonding fibers. The layer of thermally bonding fibers is termed a "shaping layer", "shape retaining layer" or "shell" and is used to provide shape to the mask and support for a filtration layer. Relative to the filtration layer, the shaping layer may reside on an inner portion of the mask (adjacent to the face of the wearer), or it may reside on an outer portion or on both inner and outer portions of the mask. Typically, the filtration layer resides outside the inner shaping layer.

In some cases, all of the layers of material are assembled together before the shaping layer is molded so that all of the layers are subjected to the molding procedure. In other cases, only the material for the shaping layer is molded and the other layers are applied afterwards. In those cases, to assist in applying the other layers to the pre-molded shaping layer and to reduce creasing, the other layers may first be preformed into a cup-shape, for example by cutting and seaming.

A molded respiratory mask that is formed by applying one or more layers of material to a pre-molded shaping layer is described in, for example U.S. Pat. No. 4,807,619. Masks that are formed by assembling all the layers of the mask together before the molding procedure are described in, for example U.S. Pat. Nos. 4,536,440; 4,807,619; 4,850,347; 5,307,796 and 5,374,458. Masks of this type offer the advantage of generally being simpler and less costly to produce especially when manufactured by a continuous process.

The present invention is concerned with providing a direct-molded respiratory mask that enables effective respiratory protection to be achieved while offering a good degree of comfort and that can be manufactured in a comparatively simple and cost-effective manner.

SUMMARY OF THE INVENTION

The present invention provides a respiratory mask comprising a molded, cup-shaped, shape-retaining shell on the concave side of which is a layer of filter material and, on the concave side of the filter layer without an intermediate shape-retaining layer, a cover web that contains a nonwoven material having a basis weight of 5 to 50 g/m$^2$ and a fiber denier of less than 3.5 which forms the inside surface of the mask, the layer of filter material and the inside layer being conformed into the cup-shaped configuration of the shape-retaining shell.

The present invention also provides a respiratory mask comprising a molded, cup-shaped, shape-retaining shell on the concave side of which is a layer of filter material and, on the concave side of the filter layer without an intermediate shape-retaining layer, a layer of blown microfiber material that forms the inside surface of the mask, the layer of filter material and the inside layer being conformed into the cup-shaped configuration of the shape-retaining shell.

The invention further provides a method of manufacturing a respiratory mask, the method including the steps of:

(i) assembling together a non-woven fibrous web containing thermally-bonding fibers, a layer of filter material and, adjacent the filter material on the side remote from the fibrous web, a cover web material comprising a layer of nonwoven material having a basis weight in the range of from 5 to 50 g/m$^2$ and a fiber denier of less than 3.5; and (ii) molding the assembled layers to the shape of a respiratory mask, whereby the fibrous web forms a cup-shaped, shape-retaining shell on the concave side of which are located the layer of filter material and the cover web material.

The invention also provides a method of manufacturing a respiratory mask, the method including the steps of:

(i) assembling together a non-woven fibrous web containing thermally-bonding fibers, a layer of filter material and, adjacent the filter material on the side remote from the fibrous web, a cover web material comprising a layer of blown microfiber material; and (ii) molding the assembled layers to the shape of a respiratory mask, whereby the fibrous web forms a cup-shaped, shape-retaining shell on the concave side of which are located the layer of filter material and the cover web material.

The inventive masks can be produced by a comparatively straightforward and efficient process which, by virtue of the simple construction of the masks, makes effective use of raw materials. The masks nevertheless offer, to the wearer, the advantages of increased comfort through use of a smooth inner cover web that does not significantly increase pressure drop through the respiratory mask. Also the location of the shape retaining shell on the outside of the mask means that the shell can function to filter out coarser particles to prevent them from reaching the filter material. This can help extend the service life of the filter.

BRIEF DESCRIPTION OF THE DRAWINGS

By way of example only, embodiments of the invention are described with reference to the accompanying drawings, in which.

DETAILED DESCRIPTION OF PREFERRED EMBODIMENTS

Figure 1:
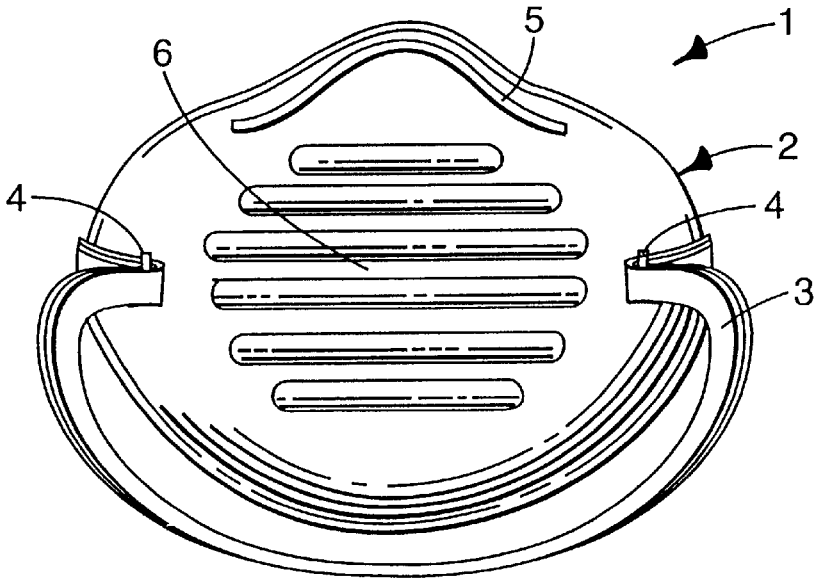
FIG. 1 is a front view of a direct-molded respiratory mask in accordance with the present invention.
Figure 2:
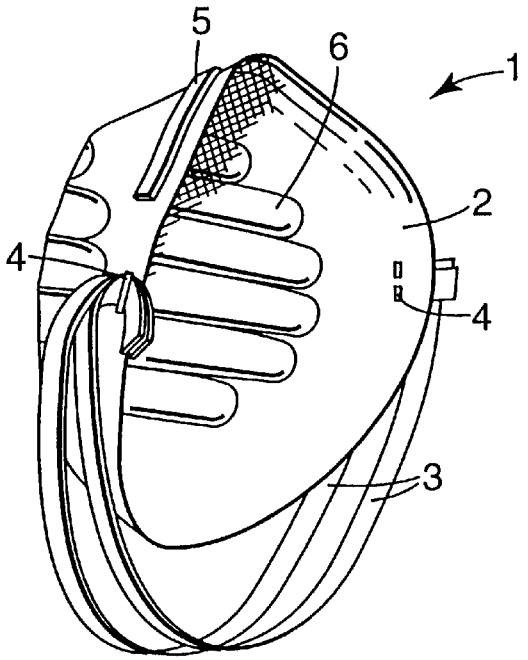
FIG. 2 is perspective rear view of the mask of FIG. 1.

The respiratory mask 1 shown in FIGS. 1 and 2 comprises a mask body 2 having a generally cup-shaped, face-fitting configuration, and two elastic head bands 3 that are stapled at 4 to the mask body at each side to hold the mask body against the face of the wearer.

The periphery of the mask body 2 is shaped to contact the face of the wearer over the bridge of the nose, across and around the cheeks, and under the chin. The mask body then forms an enclosed space around the nose and mouth of the wearer. A malleable nose clip 5 is secured on the outer face of the mask body 2, adjacent its upper edge, to enable the mask to be shaped in this region to fit to the wearer's nose. The mask body 2 is formed from a plurality of layers of material selected to ensure that it has a degree of flexibility to enable it to fit to the face of the wearer while being stiff enough to retain its shape during use. An optional corrugated pattern 6 extends through all the layers of the central region of the mask body 2.

Figure 3:
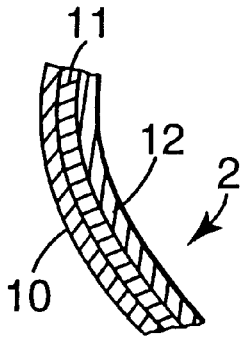
FIG. 3 is a cross-section through a part of the mask of FIGS. 1 and 2.

As shown in FIG. 3, the mask body 2 comprises an outer, resilient shape-retaining shell 10 on the concave (inner) side of which is a layer 11 of filter material and, on the inner side of the filter layer, a layer of cover web 12. The layer 11 of filter material is bonded to the shell 10 across the entire inner surface of the latter, to ensure that the filter material is retained against the shell when the mask is in use. The shell 10 functions primarily to maintain the shape of the mask and to support layers 11, 12, although it may also function as a coarse initial filter for air that is drawn into the mask. The main filtering action of the mask 1 is provided by the filter layer 11, while the inner cover web 12 provides a smooth surface that contacts the wearer's skin.

Figure 4:
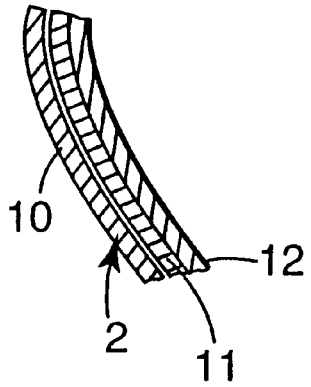
FIG. 4 is a cross-section through a part of an alternative form of mask.
Figure 5:
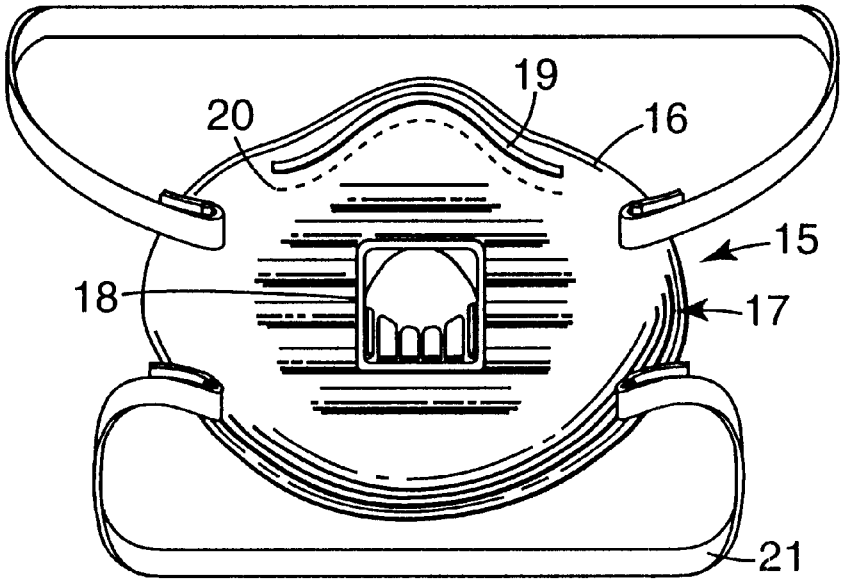
FIG. 5 is a front view of an alternative direct-molded respiratory mask in accordance with the present invention.

In the alternative construction illustrated in FIG. 4, the mask body 2 comprises the same layers 10, 11 and 12 as shown in FIG. 3, but the filter layer 11 is not bonded to the inner surface of the shell 10 across the entire surface of the latter. In this case, some other form of attachment is required between the filter layer 11 and the mask body 12 to ensure that the filter material is not drawn away from the shell during inhalation when the mask is in use. That attachment may conveniently take the form of welds that may be disposed through all the layers of the mask in appropriate locations, for example around the periphery of the mask and in the central region. Alternatively, when the mask is provided with an exhalation valve, conventionally located in the central region of the mask, the valve may serve to attach the filter material 11 to the shell 10 in this region. A mask 15 of that type is shown in FIG. 5.

The mask 15 is generally similar in shape to the mask 1 shown in FIGS. 1 and 2 except that there is an ultrasonic weld 16 extending all the way around the periphery of the mask body 17. The weld 16 extends through all the layers of the mask body 17 and is visible also on the inner surface of the mask body (not shown). In addition, the mask body 17 includes an exhalation valve 18 welded or otherwise secured in position in the central region of the mask body to lie adjacent the nose of the wearer when the mask is in use. Exhalation valves suitable for molded masks are well known. One suitable valve is that described in U.S. Pat. No. 5,325,892. The valve 18 is attached to the mask body 17 through all the layers of the latter, as is conventional, and serves to secure the layers together in this region. The layers of the mask body 17 are thus attached together both in the central region of the mask body and at its periphery.

The mask 15, like the mask 1 of FIGS. 1 and 2, includes a malleable nose clip 19 on the outer surface of the mask body 17 and, in addition, has a strip of foam 20 in the corresponding position on the inner surface of the mask body 17 to improve the fit of the mask to the wearer's face in this region. It will be appreciated that a similar foam strip could be provided in the mask 1 if so desired. The nose clip may take the form of the nose clip described in U.S. Pat. No. 5,558,089.

The elastic headbands 21 of the mask 15 are stapled to the mask body at separate locations rather than at the same location as in the mask 1 of FIGS. 1 and 2. That is not essential, however. Alternatively, in both masks, some other means of attaching the headbands could be used, for example, the headbands could be welded to the mask body 2, 17.

The mask bodies 2, 17 are formed by assembling the various layers of material together, placing the assembly between male and female mold parts, and subjecting it to heat and molding pressure, thereby forming the molded, cup-shaped, shape retaining shell 10 and conforming the filter material 11 and the cover web 12 into the configuration of the shell. A molding procedure of that type will be described in greater detail below. Alternatively, depending on the materials used, the assembled layers of material could be pre-heated in an oven and then subjected to a cold molding process as described, for example, in U.S. Pat. No. 5,307,796.

Each of the mask bodies 2, 17 may include other layers of material in addition to the layers 10, 11, 12 described above. There could, for example, be more than one filter layer on the inside of the shell 10, which would be assembled for molding along with the other layers. There also could be additional layers on the outside of the shell 10, for example an outer cover web and/or an additional filter layer. These additional outer layers could be assembled for molding along with the other layers, or pre-formed and applied to the outside of the shell 10 after the molding procedure.

The component layers of the mask body 2 will now be described in greater detail. The component layers should be selected to be compatible with the molding process employed to manufacture the mask body.

The Shell

The shell may be formed from at least one layer of fibrous material that can be molded to the desired shape with the use of heat and that retains its shape when cooled. Shape retention is typically achieved by causing the fibers of the material to bond together at points of contact between them, for example by fusion. Any suitable material known for forming the shape-retaining shell of a direct-molded respiratory mask may be used to form the mask shell, including, for example, a mixture of synthetic staple fiber, preferably crimped, and bicomponent staple fiber. The latter carries a binder component by which the fibers of the shape-retaining shell can be bonded together at fiber intersection points by heating the material so that the binder component of the bicomponent fibers flows into contact with adjacent fibers that are either bicomponent or other staple fibers. The material for the shape-retaining shell can be prepared from fiber mixtures including staple fiber and bicomponent fiber in a weight-percent ratio which may range, for example, from 0/100 to 75/25. Preferably, the material includes at least 50 weight-percent bicomponent fiber to create a greater number of intersection bonding points to increase the resilience and shape retention of the shell.

Suitable bicomponent fibers for the material of the shape-retaining shell include, for example, side-by-side configurations, concentric sheath-core configurations and elliptical sheath-core configurations. One suitable bicomponent fiber is the polyester bicomponent fiber available, under the trade designation "Celbond T254" (12 denier, length 38 mm), from Hoechst Celanese Corporation of Mooresville, N.C., U.S.A. which may be used in combination with a polyester staple fiber, for example that available from Hoechst Celanese under the trade designation "T259" (3 denier, length 38 mm) and possibly also a polyethylene terephthalate (PET) fiber, for example that available from Hoechst Celanese under the trade designation "T295" (15 denier, length 32 mm). Alternatively, the bicomponent fiber may comprise a generally concentric sheath-core configuration having a core of crystalline PET surrounded by a sheath of a polymer formed from isophthalate and terephthalate ester monomers. The latter polymer is heat softenable at a temperature lower than the core material. Polyester has the advantages that it contributes to resiliency and has less moisture uptake than other fibers.

Alternatively, the shape-retaining shell can be prepared from a material without bicomponent fibers. For example, fibers of a heat-flowable polyester can be included together with staple, preferably crimped, fibers in a shaping layer so that, upon heating of the material, the binder fibers melt and flow to a fiber intersection point where they surround the fiber intersection point. Upon cooling of the material, bonds develop at the intersection points.

A web of fibers to be used as the material for the shape-retaining shell can be conveniently prepared on a "Rando Webber" air-laying machine or a carding machine, and the bicomponent fibers and other fibers are typically used in conventional staple lengths suitable for such equipment. To obtain a shape-retaining shell having the required resiliency and shape-retention, the shell material preferably has a basis weight of at least 100 g/m$^2$, although lower basis weights are possible. Higher basis weights, e.g. 150 or more than 200 g/m$^2$, provide greater resistance to deformation and greater resiliency and may be more suitable if the mask is to be valved. Together with these minimum basis weights, the web typically has a maximum density of 0.2 g/cm$^2$ over the central area of the mask. The shell can be of a curved, hemispherical shape as shown in the drawings or it may take on other shapes as so desired. For example, the shell can have the cup-shaped configuration like the face mask disclosed in U.S. Pat. No. 4,827,924 to Japuntich.

The Filter Material

The filter material is chosen to achieve a desired filtering effect and, generally, should remove a high percentage of particles from the kind of gaseous stream which the face mask is intended to protect against. The particular fibers selected depend upon the kind of particulate to be filtered and, typically, fibers are chosen that do not become bonded together during the molding operation. Essentially any suitable material known for forming a filtering layer of a direct-molded respiratory mask may be used for the mask filtering material. Webs of melt-blown fibers, such as taught in Wente, Van A., "Superfine Thermoplastic Fibers" in Industrial Engineering Chemistry, Vol. 48, 1342 et seq. (1956), especially when in a persistent electrically charged (electret) form are especially useful (see, for example, Kubik et al, U.S. Pat. No. 4,215,682). Preferably these melt-blown fibers are microfibers having an average diameter less than about 10 micrometers (herein referred to as BMF for "blown microfiber"). Particularly preferred, having regard to the molding procedure used to produce the mask body, are BMF webs formed from polypropylene. Electrically charged fibrillated-film fibers as taught in van Turnhout, U.S. Pat. No. Re. 31,285, are also suitable. Rosin-wool fibrous webs and webs of glass fibers can also be used, as can solution-blown, or electrostatically sprayed fibers, especially in microfilm form. Electric charge can be imparted to the fibers by contacting the fibers with water as disclosed in U.S. Pat. No. 5,496,507; by corona charging as disclosed in U.S. Pat. No. 4,588,537; or tribocharging as disclosed in U.S. Pat. No. 4,798,850. Also, additives can be included in the fibers to enhance the filtration performance of webs produced through the hydrocharging process (see U.S. patent application Ser. No. 08/514,866, filed Aug. 14, 1995).

The Cover Web

The inner cover web is intended to provide a smooth surface that contacts the face of the wearer and does not provide significant shape retention to the mask body. To obtain a suitable degree of comfort, the inner cover web has a comparatively low basis weight and is formed from comparatively fine fibers. More particularly, the cover web should have a basis weight within the range of from 5 to 50 g/m$^2$ (preferably 10 to 30 g/m$^2$), and the fibers should be less than 3.5 denier (preferably less than 2 denier, and more preferably less than 1 denier). Fibers used in the cover web preferably have an average fiber diameter of about 5 to 24 micrometers, more preferably of about 7 to 18 micrometers, and still more preferably of about 8 to 12 micrometers. Fibers that are very small in diameter may impart good softness to the web but may be so soft that they stick to the wearer's face and create fizz. Although, large diameter fibers tend to impart better abrasion resistance to the web, they often do so at the expense of wearer comfort. The preferred fiber diameters set forth above can provide good wearer comfort and sufficient abrasion resistance.

The cover web material should, of course, be suitable for use in the molding procedure by which the mask body is formed and to that end advantageously has a degree of elasticity (preferably, but not essentially, 100 to 200% at break) or is plastically deformable. Advantageously, the cover web material is one that tends not to come away from the adjacent filter material after the molding operation but remains adhered without the need for adhesive between the two layers. The smoothness of the cover web material may, if desired, be further increased by calendering.

Suitable materials for the cover web are blown microfiber (BMF) materials, particularly polyolefin BMF materials, for example polypropylene BMF materials (including polypropylene blends and also blends of polypropylene and polyethylene). Preferably, the web is formed by collecting the fibers on a smooth surface, typically a smooth-surfaced drum: such materials will be referred to as "smooth BMF materials". A preferred cover web is made from polypropylene or a polypropylene/polyolefin blend that contains 50 weight percent or more polypropylene.

A suitable process for producing BMF materials for the coverweb is described in U.S. Pat. No. 4,013,816. These materials have been found to offer high degrees of softness and comfort to the wearer and also, when the filter material is a polypropylene BMF material, to remain adhered to the filter material after the molding operation without requiring an adhesive between the layers. Polypropylene (and polypropylene blends) BMF cover web materials have been found to exhibit plastic deformation to an extent not seen in, for example, comparable spunbond materials and this is believed to contribute to the tendency of those materials to remain adhered to the polypropylene BMF filter material after the molding procedure. Further contributing factors are believed to be: the comparatively low pressure drop of the cover web when formed from such a material; the tendency of the cover web and the filter material to crease together during molding; and the tendency for the cover web and the filter material to cold weld together at the edges of the mask body when the latter is trimmed after molding. Distinctly different types of non-woven web materials can be used for the inner cover web (for example spunbond webs, carded webs, and also laminates of meltblown and spunbond webs) preferably formed from, or including, fibers of a polyolefin material.

Particularly preferred materials for the cover web are polyolefin BMF materials having a basis weight in the range 15 to 35 grams per square meter and a fiber denier in the range 0.1 to 3.5, and made by a process similar to that described in the above-mentioned U.S. Pat. No. 4,013,816 except that the die-to-collector distance is adjusted to be within the range 10 to 25 cm (preferably 18 cm) and the surface temperature of the collector drum is adjusted to be within the range 20 to 55° C. (preferably 38 to 49° C.). Polyolefin materials that may be used include, for example, a single polypropylene; blends of two polypropylenes; and blends of polypropylene and polyethylene; blends of polypropylene and poly(4-methyl-1-pentene) and blends of polypropylene and polybutylene. One preferred material for the cover web is a polypropylene BMF material made by this process from the polypropylene resin "Escorene 3505G" available from Exxon Corporation having a basis weight of about 25 g/m$^2$ and a fiber denier in the range 0.2 to 3.1 (with an average, measured over 100 fibers of about 0.8). That material will be referred to as "smooth PP BMF material".

Another suitable material is a polypropylene/polyethylene BMF material (produced from a mixture comprising 85 percent of the resin "Escorene 3505G" and 15 percent of the ethylene/alpha-olefin copolymer "Exact 4023" also available from Exxon Corporation) having a basis weight 25 g/m$^2$ and an average fiber denier of about 0.8.

The BMF material is produced in the following manner: pellets of polyethylene/alpha-olefin ("Exact 4023") and pellets of polypropylene resin ("Escorne 3505G") are mixed as solids or metered as solids into an extruder. The polymers are melted and blended together in the extruder. The blend is then extruded through a die by a melt-blowing process that forms fibers at a temperature of about 290° C. and a rate of about 2000 m/min. The extruder may be either a twin screw extruder or a single screw extruder. The meltblown microfibers are projected onto a 10 cm diameter roller that has a smooth surface and is cooled by a fluid running through the roller. The temperature of the input fluid is maintained at 8.9 to 12.2° C. The roller surface temperature under the collecting microfibers is 38 to 49° C. The motion of the roller allows for the production of a continuous sheet of non-woven fabric. The product web has a thickness of about 0.015 cm and is smooth and soft.

Other suitable materials may include: spunbond materials available, under the trade designations "Corosoft Plus 20", "Corosoft Classic 20" and "Corovin PP-S-14", from Corovin GmbH of Peine, Germany; and a carded polypropylene/viscose material available, under the trade designation "370/15", from J. W. Suominen OY of Nakila, Finland.

Cover webs that are used in the invention preferably have very few fibers protruding from the surface of the web after processing. The cover webs preferably also have a smooth surface as characterized through a surface roughness determination set forth below.

Average Surface Roughness Determination

1. A rectangular sheet approximately 6 centimeters (cm) by 20 cm is used.

2. The sheet is folded over a stiff black cardboard panel approximately 10 cm by 5 cm by 0.1 cm.

3. A weight (295 grams) is used to apply a fixed tension on the folded sheet which is then clamped between two cardboard panels 10 cm by 5 cm by 0.1 cm.

4. The mount is then placed on a copy stand so that an Infinity Optics Company Infinivar® Video Microscope can be used to view the folded edge of material perpendicular to the plane of the cardboard panels.

5. The magnification is adjusted so that the field of view is approximately 1.166 cm by 1.093 cm (0.0022779 cm per pixel).

6. A fiber optic ring with a diameter of approximately 5.1 cm is placed 2.5 cm above the fabric to provide uniform darkfield illumination. This type of illumination provides high contrast and excludes the specularly reflected light.

7. The captured video images are analyzed using a Leica Quantimet Q-570 image analyzer. The gain and offset of the video imaging system are adjusted for each sample to insure maximum contrast without causing blooming or over saturation of the system.

8. The topography of the edge is found by using standard image analysis tools. The first step is to detect the fabric, which appears white on a black background. The second step is the application of a standard 3×3 Roberts kernel to define the boundary between the black background and the white fabric. The final step is to use the skeltonize function to cause the profile of the edge to be one pixel wide.

9. The image of the edge is used to define the topography of each sample. For each sample, five 1 cm profiles are evaluated.

10. The average surface roughness, Ra, is determined by defining a reference line that is a linear least squares fit of the sample topography. The average deviation from this reference line is then reported as the average surface roughness, Ra. Average surface roughness is reported in millimeters (mm).

For cover webs used in the invention, the average surface roughness, Ra, is preferably less than 0.06 mm, more preferably less than 0.04 mm, and still more preferably less than 0.02 mm.

Although the cover web has been described as being an inner cover web that would contact the wearer's face, the cover web also could be used as an outer "cover web" that is located exterior to the shaping layer and/or filter layer. Under such circumstances, the cover web could be secured to the shaping layer or filter layer as described herein.

Additional Materials

In the case in which the inner cover web does not remain adequately adhered to the filter material after the molding procedure, an adhesive may be used to bond the layers together. Any suitable adhesive compatible with the cover web and filter materials may be used including, for example, a polyolefin hot melt adhesive such as those available, under the trade designation Rextac™ E121, RT2315, RT2115, RT2215, RT2535, RTE-27 Hot Melt Adhesives from Rexene of Odessa, Tex. U.S.A.; Duraflex™ 8910PC Polybutylene Hotmelt and Eastoflex™ D1275 from Shell Oil of Houston, Tex., U.S.A.; and HL-1358-X-ZP available from H. B. Fuller, Saint Paul, Minn., U.S.A. The adhesive may be sprayed or die-coated onto the filter material when the materials are being laminated together before the molding procedure.

It was stated above that, in a mask body of the type shown in FIG. 1, the layer of filter material may be bonded to the shell across the shell's entire inner surface. That may be achieved by, for example, applying an appropriate adhesive between the shell and the filter material when the materials are being laminated together before molding. Any suitable adhesive compatible with the filter and shell materials may be used for that purpose and may be applied as a spray or die-coated onto one of the materials. Depending on the shell and filter materials, the adhesive may be a polyolefin hot melt adhesive, for example either of those specified above. Alternatively, the adhesive may be applied in the form of a non-woven adhesive web (for example "PE 120-30", "PO 100", and "PO 104" polyester adhesive webs from Bostik of Middleton, Mass., USA or "LD-4000" polyolefin adhesive web "EV-3007" ethylene vinyl acetate adhesive web, or "VI 1610" adhesive web both from Spunfab of Akron, Ohio U.S.A. which is laminated between the shell and filter materials and bonds the layers together during the molding procedure. As a further alternative, the shell may be formed from two layers of material, the inner one of which includes a binder component that melts during the molding of the mask body and that bonds the filter material to the shell. For example, the shell may comprise an outer layer consisting of a mixture of polyester bicomponent fibers and polyester staple fibers and an inner layer consisting of a mixture of polyester bicomponent fibers (which may be the same as in the outer layer) and polypropylene/polyethylene bicomponent fibers. In that case, the polyethylene component of the inner layer melts during the molding procedure and bonds the shell to the filter material. The inner layer of shell material is typically of a lower basis weight than the outer layer.

Where the above description refers generally to the individual component layers of the mask body (i.e. the shell, the filter material and the inner cover web), each of those layers could comprise more than one actual layer of material.

Molding Procedure

As already indicated above, the mask bodies are formed by assembling the various layers of the mask bodies together (i.e. the shell, the filter material, and the inner cover web, together with any additional layers as described above), placing the assembly between male and female mold parts, and subjecting it to heat and molding pressure. The general nature of the process is well known and need not be described in detail. Further information can be obtained from, for example, U.S. Pat. Nos. 4,807,619 and 4,536,440. The mold temperature and pressure depend on the materials used to form the mask bodies and, in some cases, it may be advantageous to heat the assembled layers of material before they are fed into the mold, see U.S. Pat. No. 5,307,796. During the molding process, the shell material assumes, and thereafter retains, the shape of the shell. At the same time, the filter material and cover web material are conformed into the shell shape which subsequently serves to support, and retain the shape of, those layers. Conventionally, the mold parts are gapped to allow greater loft generation in the central, generally hemispherical, filtration area of the mask body. During the molding process, a bond may be established between the shell and the filter material and/or between the filter material and the inner cover web, as already described. In that case, the gapping of the mold parts is chosen to optimize those bonds, particularly the one between the filter material and the shell. After molding, the mask bodies may need to be trimmed and, in the case of masks of the type shown in FIG. 1, are provided with headbands in any conventional manner. In the case of masks of the type shown in FIG. 5, the mask bodies are welded (e.g. by heat or ultrasonic welding) around the periphery before exhalation valves and headbands are attached in any conventional manner.

Face masks in accordance with the invention will be further described in the following examples:

EXAMPLE 1

Two layers of shell material were prepared on a "Rando Webber" air-laying machine. One layer, intended to form the outer side of the shell of the mask body, comprised 70% polyester bicomponent fiber "Celbond T254" and 30% PET fiber "T295" and had a basis weight of 140 g/m$^2$. The other layer, intended to form the inner side of the shell 10 of the mask body, comprised 70% of the same polyester bicomponent fiber and 30% polypropylene/polyethylene bicomponent fiber of the type available, under the trade designation "EAC", from Chisso Corporation of Osaka, Japan and had a basis weight of 65 g/m$^2$). Those two layers were assembled with a layer of polypropylene BMF filter material having a basis weight of 55 g/m2 and a layer of the above-described smooth PP BMF material the filter material being located between the smooth BMF material and the inner layer of shell material. The assembly was conveyed under infra-red heaters and then to a molding press operating at a temperature of about 116° C. and with a press gap of from 1.1 to 1.3 mm to effect molding of the mask bodies. The mask bodies were then trimmed and converted into masks of the type shown in FIG. 1.

EXAMPLE 2

Two layers of shell material were prepared on a "Rando Webber" air-laying machine. The layers were similar and each comprised 70% polyester bicomponent fiber "Celbond T254", 15% copolyester fiber "T259" and 15% PET fiber "T295" and had a basis weight of 100 g/m$^2$. Those two layers were assembled with a layer of polypropylene BMF filter material and a layer of smooth PP BMF material as described in Example 1, the filter material being located between the smooth BMF material and the shell material. Following a molding procedure similar to that described in Example 1, the mask bodies are trimmed and converted into masks of the type shown in FIG. 5.

All of the patents and patent applications cited above are wholly incorporated into this document by reference.

Although preferred embodiments of the invention have been described above in detail, the scope of the invention is not limited to these detailed embodiments but rather is governed by the limitations in the appended claims and any equivalents thereof. The invention may be configured in a variety of embodiments. For example, in some embodiments the filter layer or cover web may not be juxtaposed directly against the shell, i.e., there may be another layer located in between the shell and the filter or the shell and the cover web.

What is claimed is:

1. A respiratory mask that comprises:

(a) a molded, cup-shaped, shape-retaining shell;

(b) a layer of filter material that is disposed on a concave side of the shape-retaining shell; and (c) a nonwoven cover web that contains melt-blown fibers having an average fiber diameter of about 5 to 24 micrometers and having a denier of less than 3.5, the nonwoven cover web having a basis weight of 5 to 50 $g/m^2$ and being disposed on an inside surface of the mask on a concave side of the filter layer, the mask lacking a shape-retaining layer disposed on the concave side of the layer of filter material, and the cover web being conformed into the cup-shaped configuration of the shape-retaining shell.

2. The respiratory mask of claim 1, in which the cover web has a basis weight in the range of from 10 to 30 $g/m^2$.

3. The respiratory mask of claim 1, in which the cover web has a fiber denier of less than 2.

4. The respiratory mask of claim 1, in which the cover web has a fiber denier of less than 1.

5. The respiratory mask of claim 1, in which the cover web is made from a polyolefin or polyolefin-blend material.

6. The respiratory mask of claim 5, in which the cover web is made from a polypropylene or polypropylene-blend material.

7. The respiratory mask of claim 1, in which the cover web has been calendered.

8. The respiratory mask of claim 1, in which the melt-blown microfibers have an average fiber diameter of about 7 to 18 micrometers.

9. The respiratory mask of claim 1, in which the cover web adheres to the layer of filter material.

10. The respiratory mask of claim 1, in which the cover web and the layer of filter material are bonded together.

11. The respiratory mask of claim 1, in which the shape-retaining shell forms the outer surface of the mask.

12. The respiratory mask of claim 1, in which the layer of filter material is located adjacent the shape-retaining shell.

13. The respiratory mask of claim 12, in which the shape-retaining shell and the layer of filter material are bonded together.

14. The respiratory mask of claim 13, in which the shape-retaining shell comprises at least two layers of material, the innermost layer of material being bonded to the layer of filter material and to the adjacent layer of shell material.

15. The respiratory mask of claim 1, in which the shape-retaining shell, the layer of filter material, and the inside layer are secured together at discrete locations.

16. The respiratory mask of claim 15, in which the shape-retaining shell, the layer of filter material, and the inside layer are welded together at least around the periphery of the shell.

17. The respiratory mask of claim 16, in which the shape-retaining shell, the layer of filter material, and the inside layer are also secured together in the central region of the shell.

18. The respiratory mask of claim 17, further comprising a valve assembly that is located in a central region of the shape-retaining shell and that secures together the shell, the layer of filter material, and the cover web.

19. The respiratory mask of claim 1, in which the shape-retaining shell comprises a polyester or polyester-blend material.

20. The respiratory mask of claim 1, in which the filter material comprises an electret material.

21. The respiratory mask of claim 20 in which the filter material comprises a blown microfiber material.

22. The respiratory mask of claim 21, in which the blown microfiber material comprises polypropylene.

23. A method of manufacturing a respiratory mask, which method comprises the steps of:

(i) assembling together a non-woven fibrous web that contains thermally-bonding fibers, a layer of filter material and, adjacent the filter material on the side remote from the fibrous web, a cover web that comprises a layer of non-woven material that contains melt-blown microfibers, that has a basis weight in the range of from 5 to 50 $g/m^2$, and that has a fiber denier of less than 3.5; and (ii) molding the assembled layers to the shape of a respiratory mask, wherein the nonwoven fibrous web, which contains thermally bonding fibers, forms a cup-shaped, shape-retaining shell on the concave side of which are located the layer of filter material and the cover web, wherein the cover web forms an inside surface of the respiratory mask.

24. The method of claim 23, in which the cover web becomes adhered to the filter material during the molding step.

25. The method of claim 23, in which the fibrous web that contains thermally bonding fibers is located adjacent the filter material and becomes bonded to the filter material during the molding step.

26. The method of claim 25, in which the fibrous web that contains thermally bonding fibers has an outer layer and an inner layer, the inner layer being located between the filter material and the outer layer, and the inner layer becomes bonded to the filter material and to the outer layer during the molding step.

27. The method of claim 26, in which the inner layer contains a bonding material that melts during the molding step to bond the inner layer to the outer layer and to the filter material, the bonding material having a lower melting point than the softening point of the thermally-bonding fibers.

28. A respiratory mask that comprises:

(a) a shaping layer molded into a configuration that fits over the nose and mouth of a person;

(b) a filtering layer that is supported by the shaping layer; and (c) an inner nonwoven fibrous cover web located adjacent the filtering layer on a side remote from the shaping layer to contact a wearer's face when the respiratory mask is worn, the inner nonwoven fibrous cover web comprising melt-blown fibers that have an average fiber diameter of about 5 to 24 micrometers, that contain polypropylene or a polypropylene/polyolefin blend, that have an average fiber diameter of less than 24 micrometers.

29. The respiratory mask of claim 28, wherein the inner cover web comprises melt blown microfibers that contain polypropylene or polypropylene blended with a polyolefin polymer, and wherein the web has an average surface roughness of less than 0.06 mm.

* * * * *